US005377719A

United States Patent [19]

Gyllinder, deceased et al.

[11] Patent Number: 5,377,719

[45] Date of Patent: Jan. 3, 1995

[54] PNEUMATIC VALVE, PARTICULARLY FOR CONTROL OF COMPRESSED-AIR-OPERATED MEMBRANE PUMPS

[75] Inventors: Lars Gyllinder, deceased, late of Stockholm; by Anne Marie Gyllinder, legal representative, heir by Britt Gyllinder, legal representative, heir by Lena H. Blomquist, legal representative, heir all of Sweden

[73] Assignee: Dominator Maskin AB, Sweden

[21] Appl. No.: 598,725

[22] PCT Filed: Apr. 18, 1989

[86] PCT No.: PCT/SE89/00212

§ 371 Date: Oct. 13, 1992

§ 102(e) Date: Oct. 13, 1992

[87] PCT Pub. No.: WO89/10485

PCT Pub. Date: Nov. 2, 1989

[30] Foreign Application Priority Data

Apr. 18, 1988 [SE] Sweden ..... 8801423

[51] Int. Cl.[6] ..... F15B 13/01; F04B 9/12

[52] U.S. Cl. ..... 137/625.63; 91/275; 91/313; 91/337; 137/625.66; 251/47; 417/395

[58] Field of Search ..... 91/275, 313, 337; 137/625.63, 625.66; 92/85 B; 251/47; 417/395

[56] References Cited

U.S. PATENT DOCUMENTS

| | | | |
|---|---|---|---|
| 3,304,126 | 2/1967 | Rupp et al. | 91/275 X |
| 3,455,329 | 7/1969 | Roth | 137/625.66 X |
| 3,465,686 | 9/1969 | Nugier . | |
| 3,592,230 | 7/1971 | Piroutek | 137/625.66 |
| 3,847,371 | 11/1974 | Norton et al. | 91/275 X |
| 4,203,571 | 5/1980 | Ruchser | 137/625.66 |
| 4,543,977 | 10/1985 | Arav | 92/85 B |

*Primary Examiner*—Gerald A. Michalsky
*Attorney, Agent, or Firm*—Davis, Bujold & Streck

[57] ABSTRACT

A pneumatic valve, designed to control/pressurize a membrane pump, compresses a valve body (1) having gates (8–12) for compressed-air-flow/operation/pressurization of said pump. The valve body is closed by ends (2), between which a plunger (5) is to move between two end positions. The ends of the plunger and the ends of the valve body co-operate physically magnetically in order to generate just and only a retaining force, which constitutes a threshold for a certain minimum control pressure from a control-air-gate (13 or 14) and guarantees a rapid initial movement as well as a rapid transfer of the plunger to its opposite end position. Permanent magnets (15) are inserted in said plunger ends and/or in said valve body ends and designed to co-operate with projections and/or processes (17,18,20) in the opposite member in order to obtain a so-called air-cushion-damping.

6 Claims, 5 Drawing Sheets

PRIOR ART

PRIOR ART

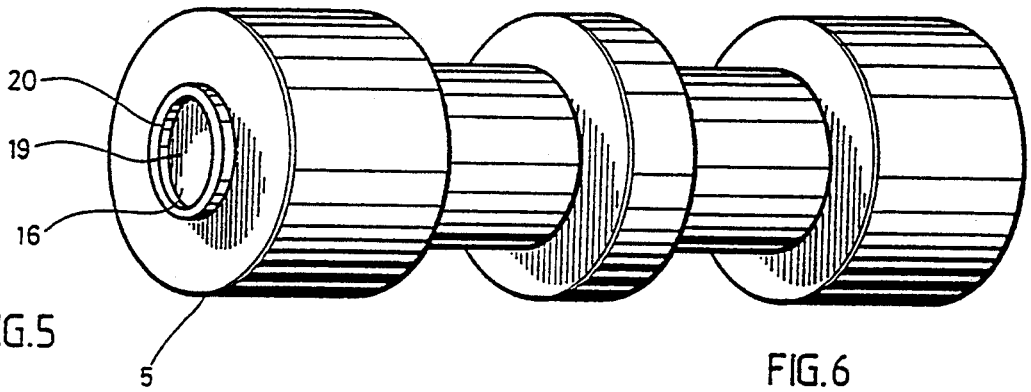
FIG.5
FIG.6
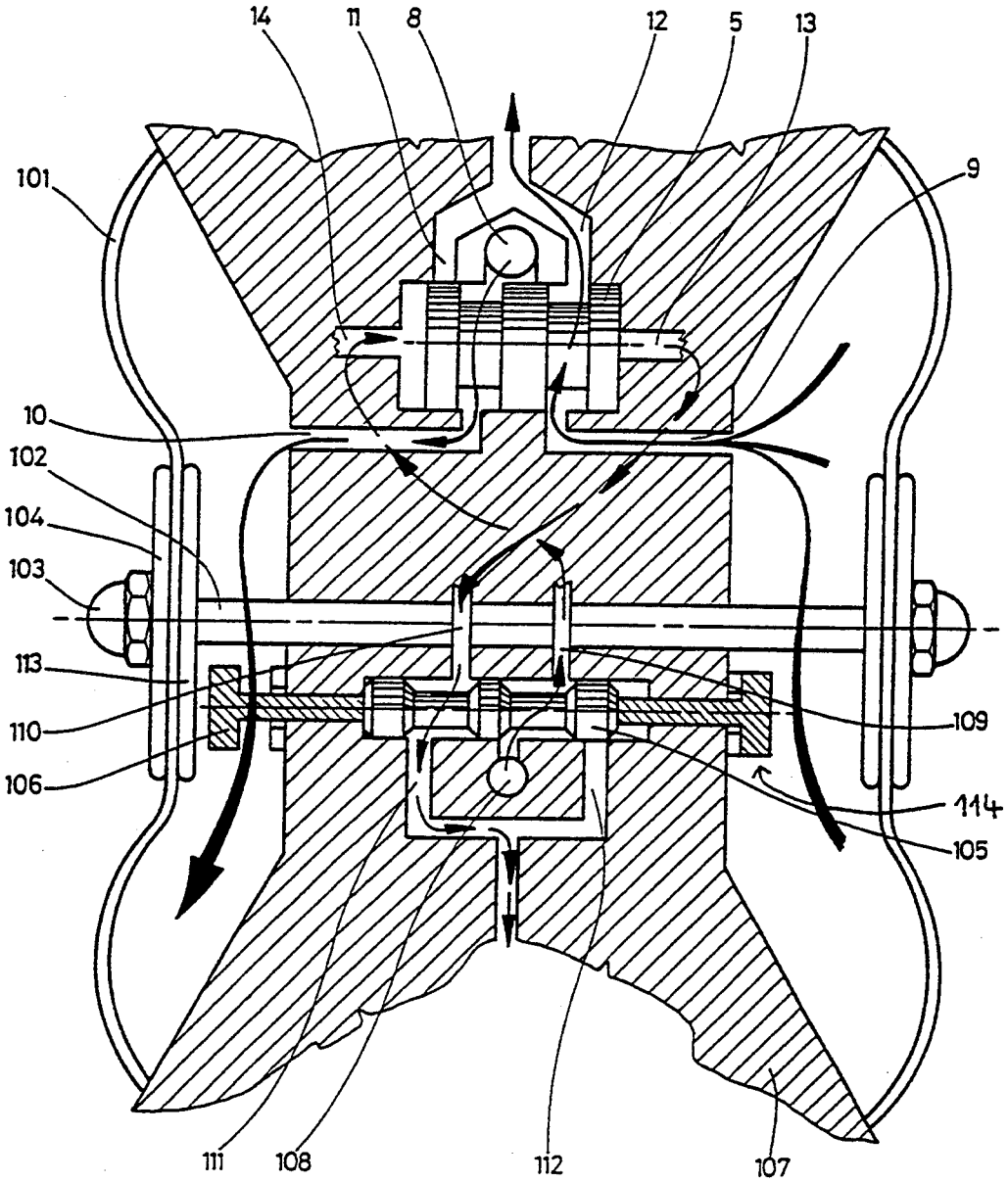

PNEUMATIC VALVE, PARTICULARLY FOR CONTROL OF COMPRESSED-AIR-OPERATED MEMBRANE PUMPS

The present invention relates to a pneumatic valve designed to control particularly a compressed-air-operated membrane pump and is set forth in detail in the preamble of patent claim 1.

U.S. Pat. No. 3,465,686 discloses an air-operated hydraulic pump using a shuttle valve, the shuttle of which is effected in all positions by very strong permanent magnets mounted in the valve housing adjacent the ends of the shuttle. The idea with this valve is to influence the shuttle in any position, i.e. even any intermediate position, so that the shuttle operates fully from end to end. For achieving such a great attractive force and yet render the valve operative, the magnets are spaced from the ends of the shuttle. This is obligatory and extremely critical, as a gap as narrow as 0.5 mm creates only 1/10 of the retaining power of a gap equal to 0 mm, i.e. when physical contact has been established between the shuttle and one of the permanent magnets. If the control air is designed to move the shuttle from one end position to the other at a pressure of ten pounds per square inch, it will certainly not when physical contact has been established between the shuttle and a permanent magnet and a releasing force of one hundred pounds per square inch will be required. It goes without saying that this previously known valve requires very accurate tolerances and will seize to function whenever there is a light play or, after some time of operation, a certain natural wear and tear.

Furthermore, this valve will create a high level of noise, as the strong magnets will make the shuttle bounce from one seat on to the other, in which connection O-rings alledgedly intended to reduce noise necessarily must render the extremely important accurate size of said gap between shuttle and permanent magnets variable and thus creating a non-desired varying influence on the retaining power due to the material used for the O-rings and not to forget varying conditions of operation and wear and tear.

The object of the invention is to improve and develop valves already known in this field, in order to avoid in particular the aforementioned drawbacks as well as other drawbacks and achieve high reliability, which will be explained in more detail in the following description.

These objects are attained according to the invention by design of the valve disclosed hereinafter.

Additional characterizing features and advantages of the present invention are set forth in the following description, reference being made to the accompanying drawings, in which:

FIG. 5 is a perspective view of a preferred embodiment of a plunger, designed to form a part of the valves according to FIGS. 3 and 4; and FIG. 6 shows a partly schematic partial section of a membrane pump, provided with a valve according to the invention.

Figure 1:
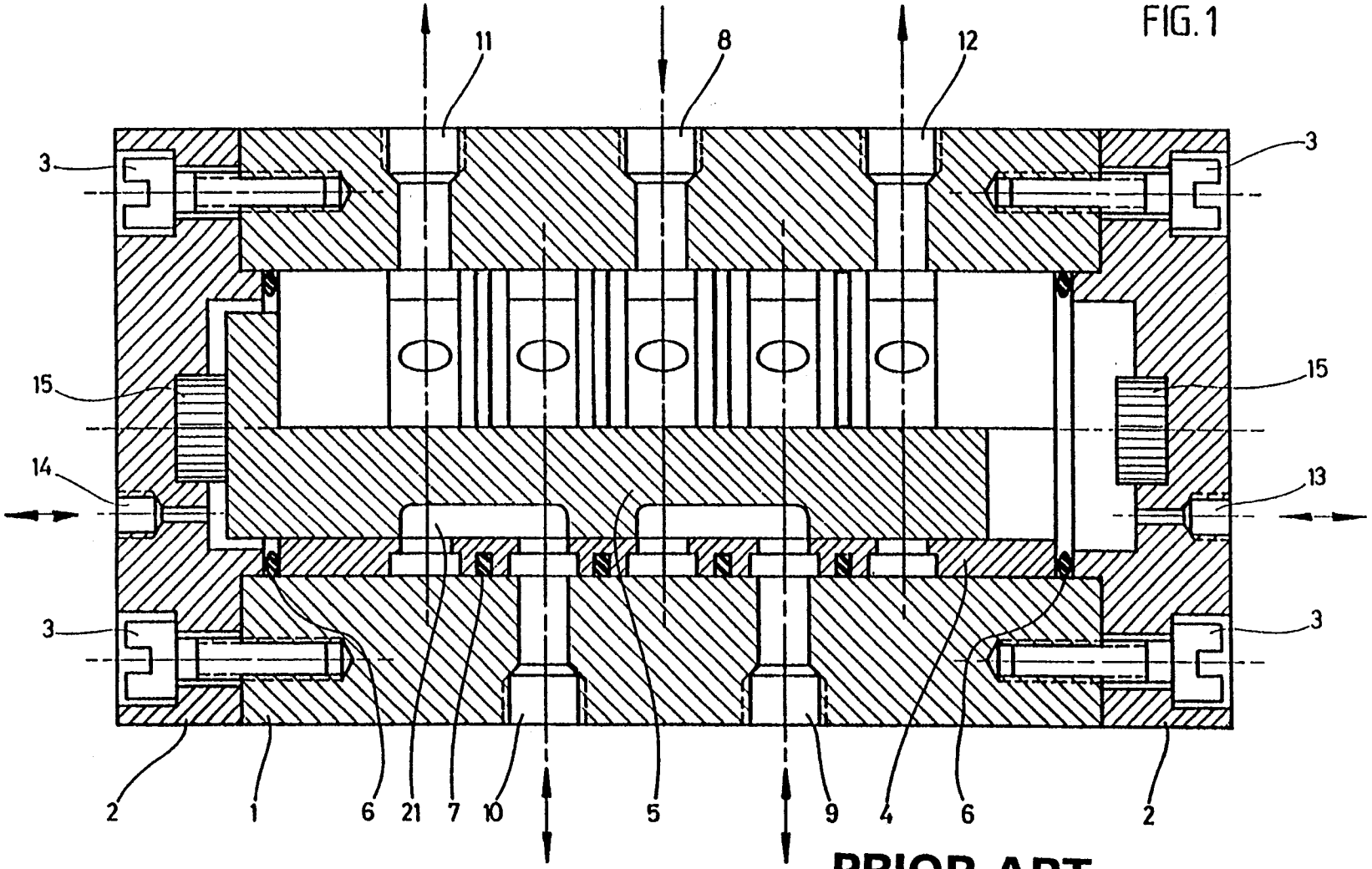
FIG. 1 shows a conventional pneumatic view, mainly in a diametrical longitudinal section, in one of two functional positions.

The present invention relates primarily to a main valve, i.e. a 3-way/5-gate-valve, which is pneumatically controlled and designed e.g. for compressed-air-operated membrane pumps.

Said valve mainly comprises a valve body 1, body ends 2, a plunger 5 and five connection gates 8, 9, 10, 11 and 12, which are disposed in said valve body, as well as a control air gate 13 and 14 respectively in each one of said two ends 2 respectively. Said ends are attached to the valve body by means of screws 3.

FIG. 1 shows a conventional valve with a presently used design, plunger 5 being disposed in a valve cap 4 having requisite O-ring seals 6 and 7 respectively. Plunger 5 is actuated through gate 13 or 14 by a compressed-air-impulse, which subsequently to the work done is exhausted. FIG. 1 shows plunger 5 in its left position. Thus, it has been actuated by compressed air, which has been fed through gate 13. When the plunger reaches its end position, its movement is damped, e.g. by means of a stop element, namely a shock absorber rubber 15. In this position the main air quantity is fed into the valve through input gate 8, out through output gate 9 and then to the pump membrane in order to perform the pumping.

Exhaust gate 10, which is connected to e.g. a second air chamber of a compressed-air-operated membrane pump, communicates with the exterior air and the air is exhausted through a recess 21 in plunger 5 and a ventilating gate 11.

When the compressed air has performed its work, the control air is exhausted through gate 13, in case it has not been exhausted earlier, and gate 14 is pressurized, plunger 5 thereby moving in valve cap 4 to its right hand end position. Gate 10, which so far has been vented, is now pressurized by means of air entering through gate 8 and one of two recesses 21, 22 in plunger 5, the connection between gate 8 and gate 9 being simultaneously disrupted and gate 9 being connected to a ventilating gate 12, air chamber no. 1 thereby being exhausted.

In a compressed-air-operated membrane pump the pressurization and the exhaustion through gates 13 and 14 respectively are done by means of a control valve, which is actuated by the end positions of the membranes. Additional embodiments are possible, in which said control valve is actuated e.g. by the position of the pump shaft and the pump shaft is in that case the shaft which connects the two membranes.

In a compressed-air-operated membrane pump its capacity and its lifting height are controlled by means of the amount of compressed air and its pressure, when it appears at gate 8. For practical reasons a branching from gate 8 is provided, which feeds compressed air to said control valve, i.e. the same pressure is used to operate the pump as to control main valve plunger 5.

Figure 2:
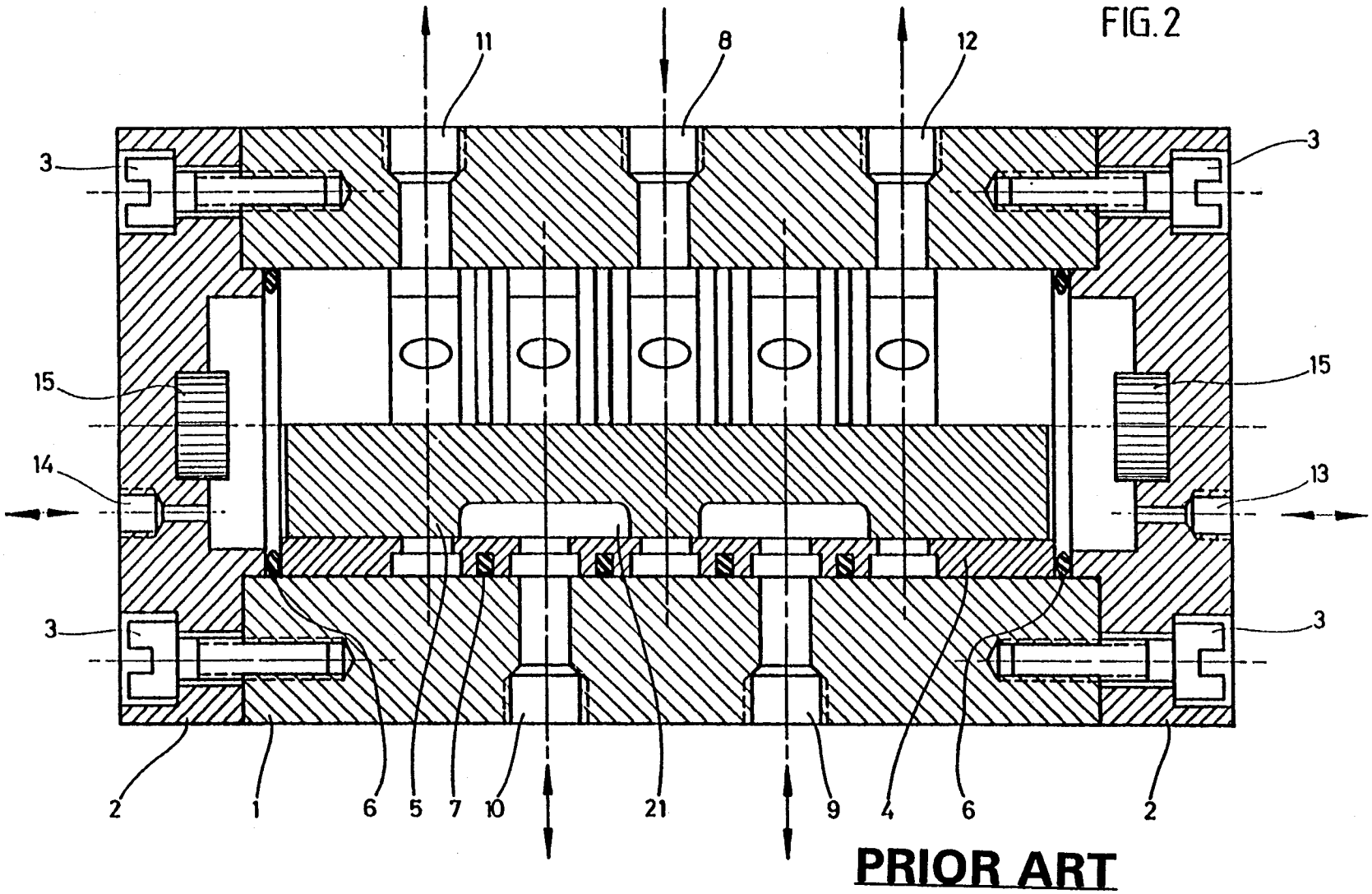
FIG. 2 shows a corresponding view of the same valve, its plunger being placed in an ineffective or locking intermediate position.

Normally this system works faultlessly, but not in those instances when the pump is to be operated using a most reduced air pressure, in order to on some occasions utilize a flow, which approaches 0, from a pump having a substantial capacity, a sufficient air pressure being available in order to operate the pump, but an insufficient air pressure to control main valve plunger 5, and consequently the plunger may in some instances end up in an intermediate position, shown in FIG. 2. This situation occurs often, if the air flow to the pump is cut off and there is a relatively large air volume between the cut-off area and the main valve of the pump and the pump is operated until the air has been expended. This happens often in work shops operating in an intermittent way. Shortly before the air pressure ceases completely, an impulse intended to shift the position of the main valve plunger may issue and due to the air expense into the air chamber of the pump, while a smaller amount of air is expended to control the plunger, the amount of air available may turn out to be insufficient to push the plunger to the opposite end position and the plunger will stop in an intermediate position, which is shown in FIG. 2. It is true that at this very moment no shut-down has occurred, but when compressed air again is fed in order to start the pump, the compressed-air-flow via gate 8 has been completely shut off from the rest of the gates and the pump cannot be started.

In order to avoid this drawback the following invention is used, the main valve having been modified:

At the ends of plunger 5 counter stop members in the form of magnets 16 have been inserted and in those instances when ends 2 have not been made of a magnetic material a stop element in the form of a soft iron core 17 has been disposed in the plate where previously shock absorber rubber 15 was disposed. Of course, said magnets may be disposed in said ends and if the plunger is not made of a magnetic material, then said counter stop members may be made of a soft iron core 17. This device is shown in FIG. 3.

Members 16, 17 lock plunger 5 in the respective end positions and a force is needed, which can be adjusted, in order to move plunger 5, i.e. the pressure of the compressed air which is fed into gates 13 and 14 respectively must be sufficiently large to over come the attractive force of the magnet. In case said pressure is insufficient, plunger 5 will remain in its end position and the pump will quit, but in case the pressure is sufficient, the pressure and the air volume are also sufficient to push the plunger into its opposite end position, where it is locked by means of the magnetization force.

Regarding the already known embodiments there is a risk that when the pump is hauled plunger 5, due to vibrations and shocks, will end up in an intermediate position, which hinders the start of the pump. This is avoided in an efficient way by means of the present invention.

Figure 3:
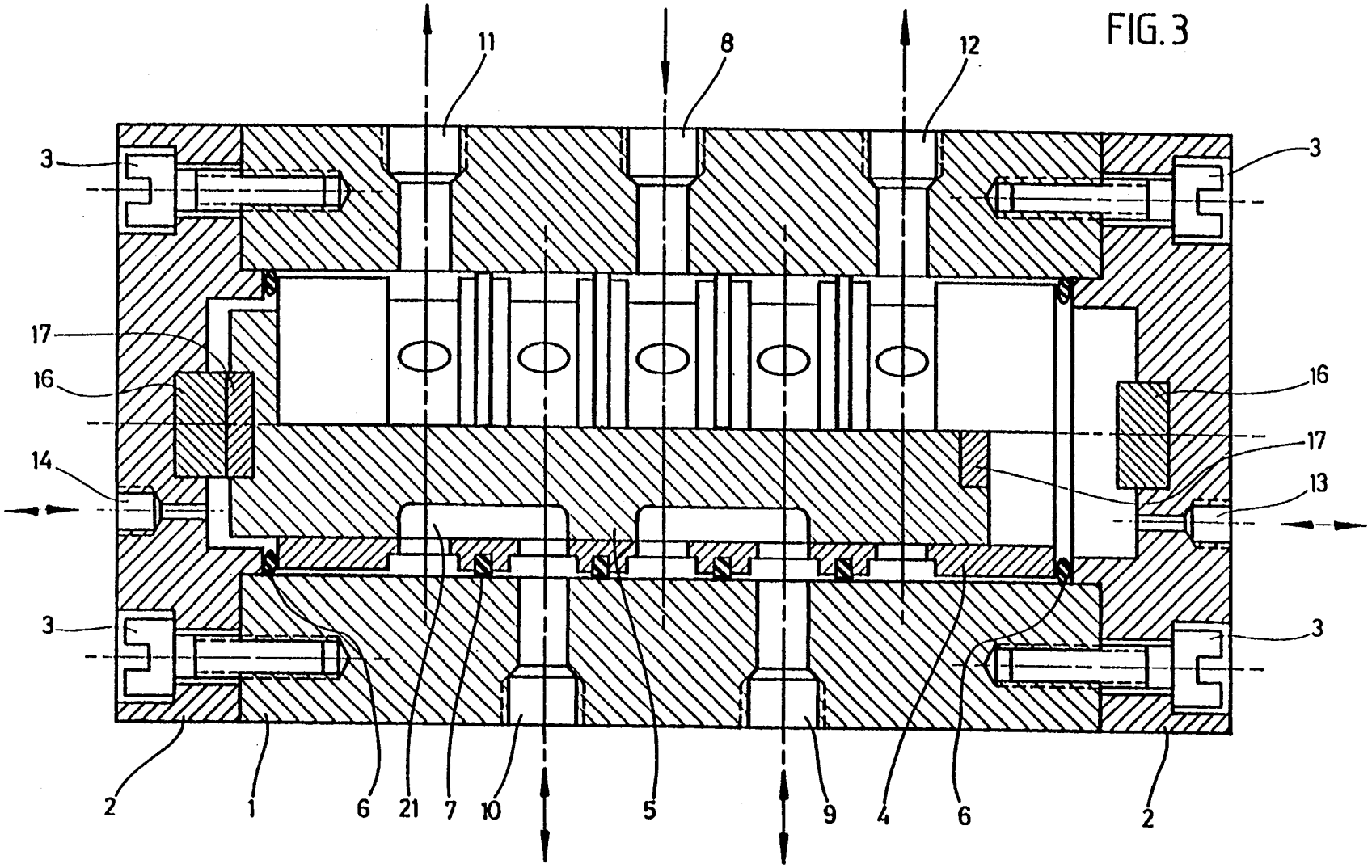
FIG. 3 is a view which corresponds to FIG. 1 and shows a valve according to the present invention.
Figure 4:
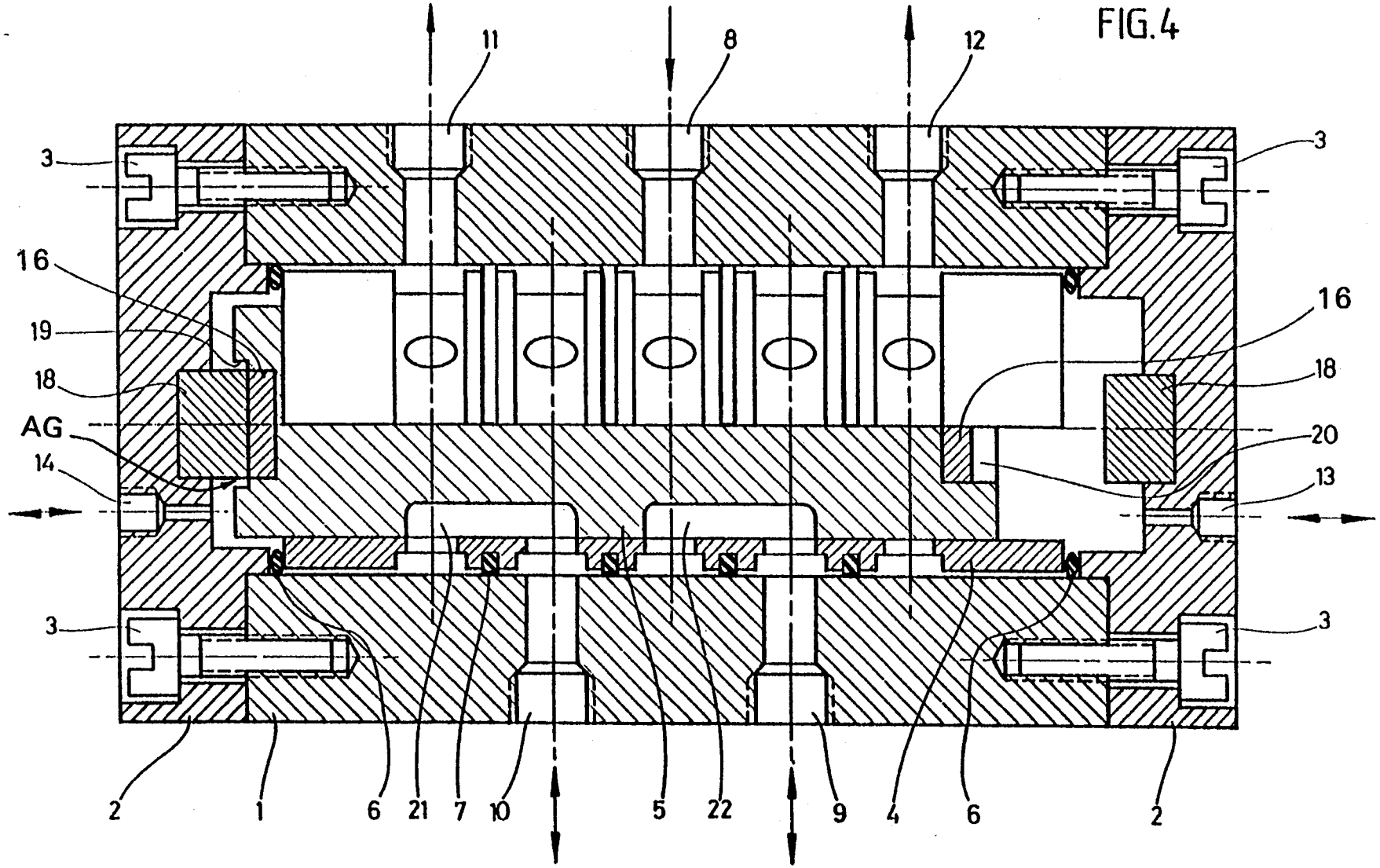
FIG. 4 is a view which corresponds to FIG. 1 and shows another embodiment of a valve according to the invention.

The embodiment described and shown in FIG. 3 does not involve any damping of plunger 5 against ends 2, since shock absorber rubbers 15 have been replaced by a permanent magnet and a soft iron core. Of course, said two parts can be designed in such a way that no strength problems will arise, but on the other hand the valve will emit a harder sound, which may prove to be troublesome, particularly if large valves are used. In one embodiment of the invention permanent magnet 16 is inserted deeper into plunger 5 and in this way a circular cavity 19 is formed in the ends of the plunger. See FIG. 4. The diameter of this cavity is adapted in such a way, on comparison with previous embodiments, that soft iron core 17 is replaced with a somewhat thicker core 18, which fits into cavity 19. Between core 18 and plunger 5 there is formed a narrow air gap AG, through which the air trapped in cavity 19 is to pass. This gap is adapted to provide an air-cushion-damping here and in this way the above-mentioned drawbacks with an elevated sound level disappears.

According to FIG. 5 a permanent magnet or a soft iron core is fitted into the two plunger ends, and the free end surface of this magnet or core preferably is positioned in the same plane as the respective plunger ends. Member 16 is surrounded by a projection 20, which protrudes from said end surfaces and comprises a cylindrical tube fastened to the plunger end and made of e.g. aluminum. In this way a cavity 19 is formed, which can cooperate with member 15 in the way described above in order to provide a so called air-cushion-damping.

Of course, also the plunger end itself may be so closely fitted into a recess in said ends, that a damping is obtained.

A preferred field of application for a valve according to the present invention is illustrated in FIG. 6. The following references numerals are used: 101 a membrane, 102 a membrane shaft, 103 a nut, 104, 113 mounting plates, 114 a control valve, 105 a control valve shaft, 106 a control valve operating shaft, 107 a pump body, 108 a control valve outlet, 109 a control valve connection, 110 a control valve connection, 111, 112 a branching duct. The air flow passages are shown by arrows and the mode of operation of the pump, which is already known, probably is easy to understand.

Summarizing the present invention, this emanates from the idea of making use of a small yet sufficient holding or retaining power as a treshold for releasing the plunger, which thus will be unaffected by magnetic power as soon as it has been released from the actual magnet. An example will make this quite clear. When physical contact has been established between plunger and magnet, the latter develops a retaining force of e.g. 0.34 kp, which is app. 0.75 pounds. As soon as this power or treshold has been overcome and the plunger has left the magnet for as little as 0,5 mm, which is 20/1000", the retaining force will be reduced to app. 0.03 kp, which is app. 0.066 pounds. Therefore, one can say that once the plunge has left one of the magnets, the magnetic influence on same cannot be measured in practice any longer. A valve designed in this way will accordingly not prevent a pump from working in very low regions of pressure and capacity, which often is desirable if not crucial.

Often, a retaining force equal to 10 mbar will be sufficient for a valve according to the invention. When in such a case the plunger has been released from its retained end position, it can move about freely without the magnets exerting any influence on same. Beyond a very narrow gap of up to 0.5 or 1.0 mm, the power of the magnets is so small, that the friction of the plunger in relation to a surrounding sleeve is bigger. Thus, the invention conceived the idea, that a comparatively low release-treshold is all what matters, and that everything considerably stronger than so will be detrimental to the desired mode of operation of a valve of this kind and even counteract if not all but some objectives. Thanks to the shock absorbing features bringing about an air-cushion-damping and slowing down the speed of the plunger, the valve according to the invention will be utmost silent in operation and gain a long life. Needless to say, that in manufacture and assemblance extreme tolerances won't have to be observed.

The field of application of the valve is of course not limited to compressed-air-operated membrane pumps, but the valve is always expedient to use in e.g. vibrating, shaking machines and various equipments, in which most reduced air pressures are to be used.

We claim:

1. A pneumatic valve comprising a valve body (1) having a longitudinal valve bore extending therethrough, said valve bore being closed at both opposed ends via valve body ends (2), and each of said valve body ends (2) having an associated control air gate (13, 14) communicating with one end of said valve bore;

a plurality of gates (8–12) communicating with a side wall portion of said valve body (1) for channeling a fluid through said pneumatic valve;

a plunger (5) being slidably located within said valve bore, said plunger (5) having two annular recesses (21, 22) formed in an exterior surface thereof and said two annular recesses (21, 22) being positioned, upon movement of said plunger (5) within said valve bore relative to said plurality of gates (8–12), for selectively guiding the fluid to desired ones of said plurality of gates (8–12); and magnetic means for magnetically retaining said plunger in a desired one of first and second end positions of said valve bore;

wherein said magnetic means for magnetically retaining said plunger in an end position of said valve bore comprises two first mating magnetic members, one of said two first mating magnetic members is supported on each opposed end of said plunger, and two second mating magnetic members, one of said two second mating magnetic members is supported on each said valve body end, and one pair of said first and second mating magnetic members contact one another when said plunger is in the first of the two end positions of said valve; each pair of said first and second mating magnetic members, when in contact with one another, generates a magnetic retaining force therebetween of between about 5–200 mbar, and the retaining force is only great enough to insure that said plunger (5) is retained in a desired end position, until a sufficient minimum control pressure, which will guarantee that said plunger will travel from one end position to the other opposed end position, is supplied via said associated control air gate (13, 14) but the retaining force is also sufficiently small enough so that the retaining force is only effective when said first and second mating magnetic members are closely adjacent one another so that the retaining force does not appreciably interfere with motion of said plunger when traveling from the first end position to the second end position;

the retaining force is negligible once one of said two first mating magnetic members is separated from its associated second mating magnetic member by a distance of about 1.0 mm;

said two first mating magnetic members comprises a pair of permanent magnets and said two second mating magnetic members comprises a pair of soft iron cores; and each opposed end of said plunger is provided with a cylindrical projection which defines a cavity for receiving one of said first mating magnetic members therein, said cylindrical projection having an inner diameter slightly larger than an exterior diameter of the associated second mating magnetic member so that, as said associated second mating magnetic member is received within said cylindrical projection, an air gap is form therebetween which allows air to escape and provide air cushioning as said first and second magnetic members are brought into engagement with one another.

2. A pneumatic valve comprising a valve body (1) having a longitudinal valve bore extending therethrough, said valve bore being closed at both opposed ends via valve body ends (2), and each of said valve body ends (2) having an associated control air gate (13, 14) communicating with one end of said valve bore;

a plurality of gates (8–12) communicating with a side wall portion of said valve body (1) for channeling a fluid through said pneumatic valve;

a plunger (5) being slidably located within said valve bore, said plunger (5) having two annular recesses (21, 22) formed in an exterior surface thereof and said two annular recesses (21, 22) being positioned, upon movement of said plunger (5) within said valve bore relative to said plurality of gates (8–12), for selectively guiding the fluid to desired ones of said plurality of gates (8–12); and magnetic means for magnetically retaining said plunger in a desired one of first and second end positions of said valve bore;

wherein said magnetic means for magnetically retaining said plunger in an end position of said valve bore comprises two first mating magnetic members, one of said two first mating magnetic members is supported on each opposed end of said plunger, and two second mating magnetic members, one of said two second mating magnetic members is supported on each said valve body end, and one pair of said first and second mating magnetic members contact one another when said plunger is in the first of the two end positions of said valve; each pair of said first and second mating magnetic members, when in contact with one another, generates a magnetic retaining force therebetween, and the retaining force is only great enough to insure that said plunger (5) is retained in a desired end position, until a sufficient minimum control pressure, which will guarantee that said plunger will travel from one end position to the other opposed end position, is supplied via said associated control air gate (13, 14) but the retaining force is also sufficiently small enough so that the retaining force is only effective when said first and second mating magnetic members are closely adjacent one another so that the retaining force does not appreciably interfere with motion of said plunger when traveling from the first end position to the second end position; and each of said opposed ends of said plunger has a circular cavity formed therein which accommodates said first mating magnetic member, said circular cavity has a diameter which is slightly larger than an exterior diameter of said associated second mating magnetic member so that, as said associated second mating magnetic member is received within said circular cavity, an air gap is form therebetween which allows air to escape and provide air cushioning as said first and second magnetic members are brought into engagement with one another.

3. A pneumatic valve according to claim 2, wherein the retaining force is negligible once one of said two first mating magnetic members is separated from its associated second mating magnetic member by a distance of about 1.0 mm.

4. A pneumatic valve according to claim 2, wherein the retaining force is less than a sliding frictional force between said plunger and an inner surface of said valve bore once one of said two first mating magnetic members is separated from its associated second mating magnetic member by a distance of about 0.5 mm.

5. A pneumatic valve according to claim 2, wherein the retaining force is between about 10–50 mbar.

6. A pneumatic valve according to claim 2, wherein said two first mating magnetic members comprises a pair of permanent magnets and said two second mating magnetic members comprises a pair of soft iron cores.

* * * * *